US005420386A

United States Patent [19]

Reinelt

[11] Patent Number: 5,420,386

[45] Date of Patent: May 30, 1995

[54] SWITCH ASSEMBLY

[75] Inventor: Ernest Reinelt, Laguna Niguel, Calif.

[73] Assignee: Eaton Corporation, Cleveland, Ohio

[21] Appl. No.: 247,860

[22] Filed: May 23, 1994

[51] Int. Cl.[6] ..... H01H 13/06

[52] U.S. Cl. ..... 200/302.2; 200/302.1; 277/152

[58] Field of Search ..... 200/302.2, 302.1, 34, 200/330, 302.3, 520; 277/152, 180

[56] References Cited

U.S. PATENT DOCUMENTS

| | | | |
|---|---|---|---|
| 3,315,535 | 4/1967 | Stevens | 74/100 |
| 4,152,564 | 5/1979 | Wirz | 200/302.1 |
| 4,496,813 | 1/1985 | Fukushima | 200/314 |
| 4,520,334 | 5/1985 | Stearley et al. | 335/186 |
| 5,294,900 | 3/1994 | Mohabbatizadeh et al. | 335/20 |
| 5,296,826 | 3/1994 | Hart et al. | 335/132 |

*Primary Examiner*—Henry J. Recla
*Assistant Examiner*—David J. Walczak
*Attorney, Agent, or Firm*—Tarolli, Sundheim & Covell

[57] ABSTRACT

An improved switch assembly includes a housing and a push button which is movable relative to the housing between extended and retracted positions. Upon manual actuation of the push button, the push button is moved into the housing from the extended position to the retracted position. Upon releasing of the push button, the push button moves back out of the housing from the retracted position to the extended position. An improved seal is provided to seal a joint between the push button and the housing. During movement of the push button from the extended position to the retracted position, the seal provides relatively little resistance to movement of the push button. However, upon movement of the push button from the retracted position back to the extended position, the seal provides substantially greater resistance to movement of the push button to prevent overtravel of the push button past the desired extended position.

17 Claims, 4 Drawing Sheets

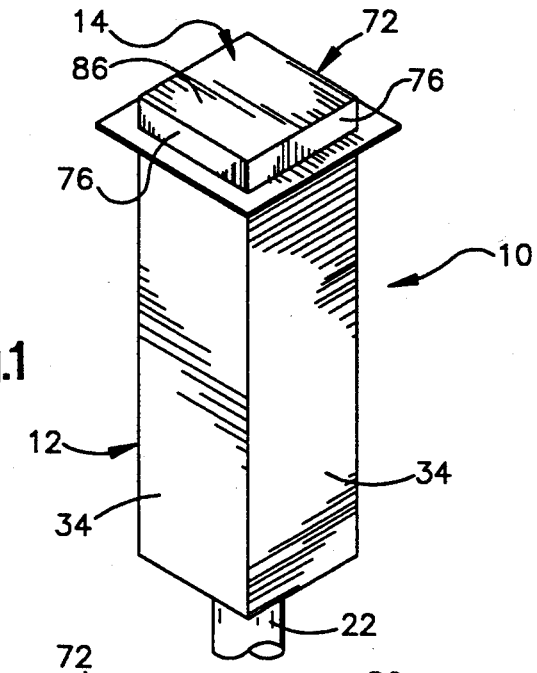
Fig.1
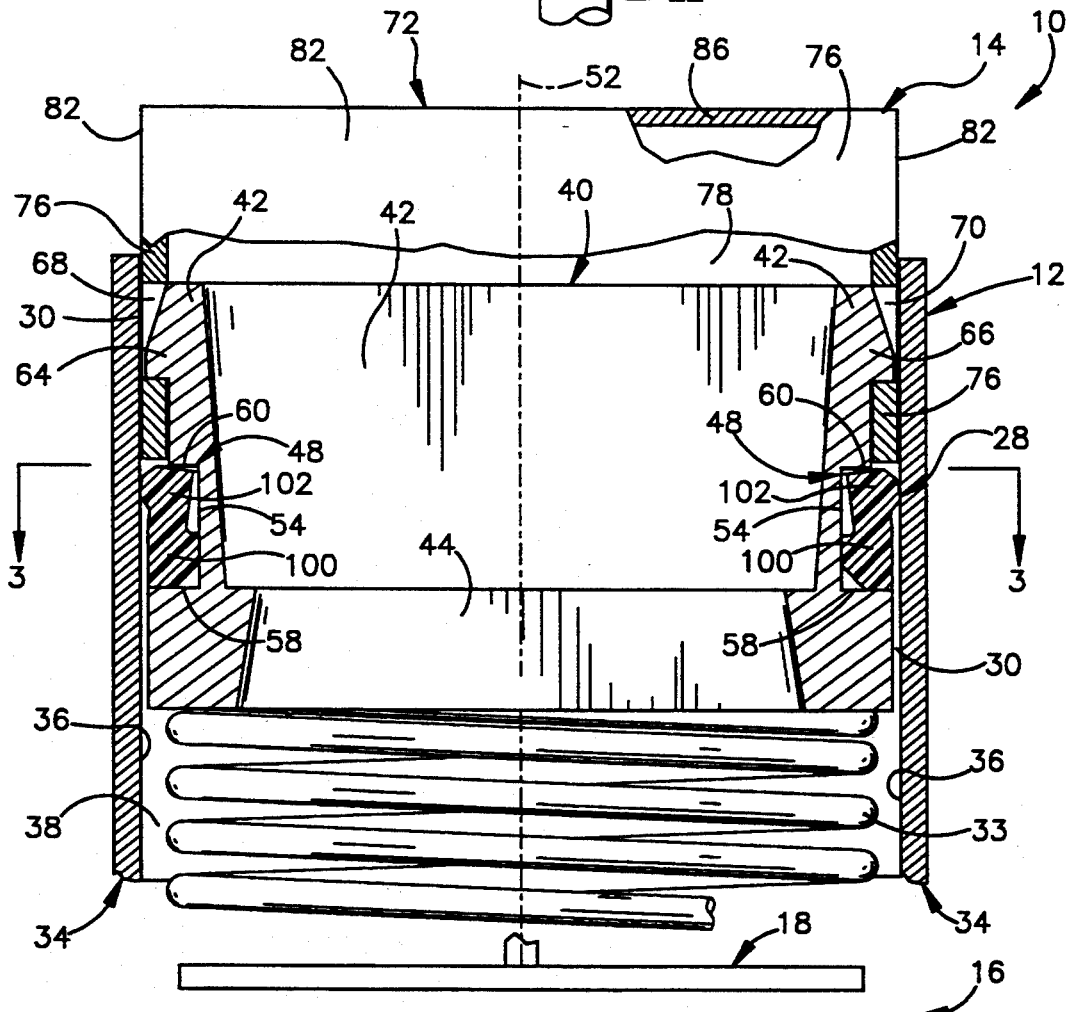
Fig.2
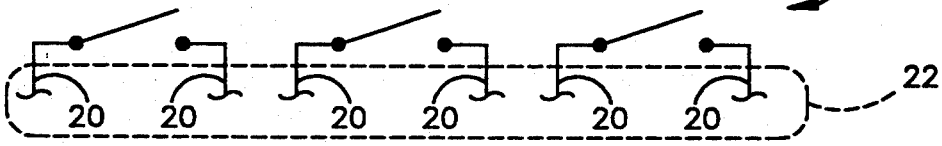

SWITCH ASSEMBLY

BACKGROUND OF THE INVENTION

The present invention relates to a push button switch assembly for use in electrical circuitry.

Known push button switch assemblies are disclosed in U.S. Pat. Nos. 3,315,535; 4,496,813; 4,520,334; 5,296,826; and 5,294,900. Push button switch assemblies of the type disclosed in these patents have previously utilized a rubber seal in a groove on the outside of the push button. The seal engages inner side walls of a switch housing. The seal has been lubricated with silicone grease.

The seal prevents dust and moisture from entering a joint between the push button and housing. The seal also acts as an energy damper to prevent overtravel or pop-out of the push button when the switch is released after having been manually actuated. Overtravel of the push button tends to result when the push button is abruptly released and is rapidly accelerated towards its extended position by springs in the switch assembly.

After switch assemblies having this known construction have been used for a few years, the silicone grease tends to disappear. When the silicone grease disappears, the switch assembly tends to become nonfunctional. Nonfunctioning of the switch assembly may be caused by overtravel of the push button and/or jamming of the seal in a joint between the push button and the housing and/or other causes after the silicone grease associated with the seal disappears.

SUMMARY OF THE INVENTION

An improved switch assembly includes a push button which is movable relative to a housing between an extended position and a retracted position to actuate electrical switches in the switch assembly. A seal is provided to seal a joint between the push button and the housing. The seal does not require silicone grease.

The improved seal provides relatively small resistance to movement of the push button from the extended position to the retracted position. However, the seal provides a relatively large resistance to movement of the push button from the retracted position to the extended position. By providing a relatively large resistance to movement of the push button from the retracted position to the extended position, the seal prevents overtravel of the push button past the extended position.

The improved seal has a base section which is connected with the push button. A cantilevered arm section extends from the base section and has a free end portion which engages a side wall of the housing. The free end portion of the arm section transmits force between the arm section and the housing. This force resiliently tensions the arm section and deflects the arm section away from the joint between the push button and the housing during movement of the push button from the extended position toward the retracted position. The arm section is resiliently compressed and deflected toward the joint between the push button and the housing during movement of the push button from the retracted position back toward the extended position.

BRIEF DESCRIPTION OF THE DRAWINGS

The foregoing and other features of the invention will become more apparent upon a consideration of the following description taken in connection with the accompanying drawings wherein:

FIG. 1 is a pictorial illustration of a switch assembly constructed in accordance with the present invention;

FIG. 2 is an enlarged schematic sectional view illustrating the relationship between a housing, push button and seal of the switch assembly of FIG. 1;

DESCRIPTION OF ONE SPECIFIC PREFERRED EMBODIMENT OF THE INVENTION

General Description

Figure 3:
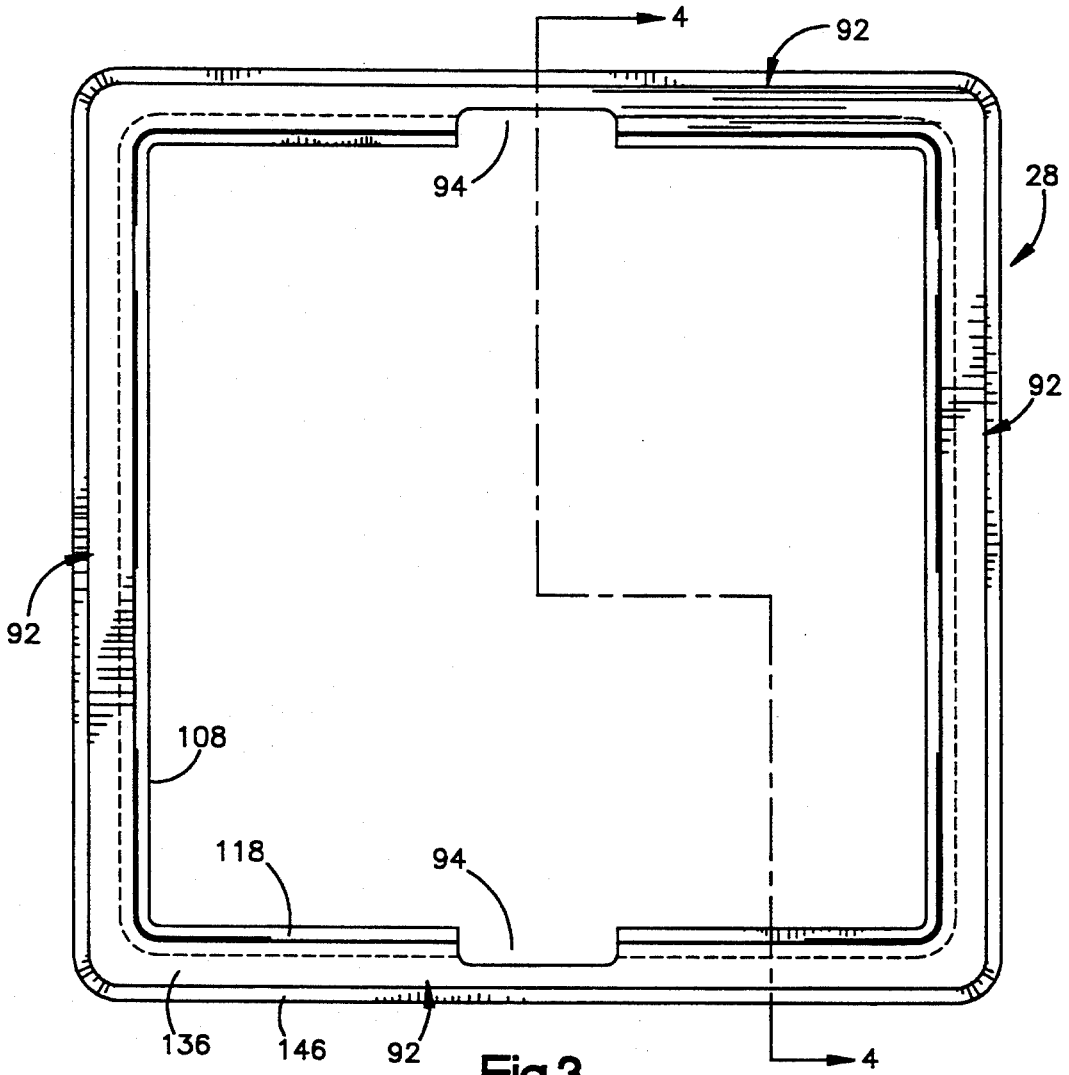
FIG. 3 is a plan view, taken generally along the line 3—3 of FIG. 2, illustrating the construction of the seal.

A switch assembly 10 (FIG. 1) constructed in accordance with the present invention includes a housing 12 and a push button 14. To actuate electrical switches 16 (FIG. 2), the push button 14 is manually moved from the extended position of FIGS. 1 and 2 into the housing 12. As the push button 14 is manually depressed into the housing 12, a linkage, which is indicated schematically at 18 in FIG. 2, actuates the electrical switches 16 to change an electrical circuit. The electrical switches 16 are connected with the electrical circuit by conductors 20 disposed in a cable 22 (FIG. 1).

Although the electrical switches 16 and the linkage 18 have been indicated schematically in FIG. 2, it is contemplated that they may have the construction disclosed in either U.S. Pat. No. 5,296,826 issued Mar. 22, 1994 and entitled "Switch Assembly", or in U.S. Pat. No. 5,294,900 issued Mar. 15, 1994 and entitled "Switch Assembly". In one specific embodiment of the switch assembly 10, the electrical switches 16 and the linkage 18 (FIG. 2) had a construction similar to the construction of a switch assembly which is commercially available from Eaton Corporation, Aerospace and Commercial Controls Division, 1640 Monrovia Avenue, Costa Mesa, Calif. under the designation of 96182. Of course, the electrical switches 16 and the linkage 18 could have a different construction, for example, the construction disclosed in U.S. Pat. No. 3,315,535 issued Apr. 25, 1967 and entitled "Alternate Action Switch Mechanism".

In accordance with a feature of the present invention, an improved seal 28 (FIG. 2) is provided to seal a joint 30 between the push button 14 and the housing 12. The seal 28 is not lubricated with silicone grease or other lubricant. The seal 28 provides a relatively small resistance to inward movement of the push button 14 from the extended position of FIG. 2 to a retracted position in which the push button is telescoped further into the housing 12. However, the seal 28 provides a relatively large resistance to outward movement of the push button 14 from the retracted position back to the extended position.

As the push button 14 is manually depressed, against the influence of a biasing spring 33 (FIG. 2), the seal 28 provides relatively little resistance to downward movement (as viewed in FIG. 2) of the push button 14. Once the push button has reached a fully retracted position in the housing 12 and the linkage 18 has actuated the electrical switches 16 to change an electrical circuit, the push button 14 is released.

Upon quickly releasing the push button 14, the spring 33 tends to accelerate the push button 14 upward (as viewed in FIG. 2) back toward the extended position. This tends to result in the combined effect of the spring 33 and the inertia of the linkage 18 and push button 14 causing the push button to pop out or overtravel past the desired extended position. By providing a relatively large resistance to movement of the push button 14 from the retracted position to the extended position, the improved seal 28 retards the push button 14 to prevent overtravel of the push button past the desired extended position. However, the resistance provided by the seal 28 is not so great as to prevent movement of the push button 14 back to the extended position of FIG. 2 under the influence of the spring 33.

Housing and Push Button

The housing 12 (FIG. 1) is formed of sheet metal and has a rectangular configuration. The housing 12 includes a rectangular array of side walls 34 (FIGS. 1 and 2). Each of the rectangular side walls 34 has a smooth flat inner side surface area 36 (FIG. 2) along which the rectangular seal 28 slides during movement of the push button 14 between the extended and retracted positions. It should be understood that the housing 12 could have a configuration which is different than the illustrated rectangular configuration. For example, the housing 12 could have a cylindrical or triangular configuration.

The side walls 34 are of approximately the same size and cooperate to define a rectangular space 38 in which the push button 14 is movable. In addition to the push button 14, the spring 33, linkage 18 and electrical switches 16 are disposed in the space 38. The electrical switches 16 are connected with an array of terminals at a lower end portion (as viewed in FIG. 1) of the housing 12. The conductors 20 (FIG. 2) in the cable 22 are connected with these terminals.

The rectangular push button 14 is slidably received in the space 38 in the housing 12. The push button 14 has a cross sectional configuration which is slightly smaller than the cross sectional configuration of the space 38. This results in space being provided at the joint 30, between the inner side surface areas 36 on the side walls 34 of the housing 12 and the push button 14. The joint 30 has a rectangular configuration and is of uniform size and extends completely around the push button 14.

The push button 14 includes a rectangular base 40. The rectangular base 40 is molded as one piece of a suitable polymeric material and has four rectangular side walls 42. The side walls 42 are interconnected in a rectangular array. The side walls 42 extend upward from a relatively thick inner end portion 44 of the base 40.

A groove 48 (FIG. 2) is formed in the base 40 of the push button 14. The groove 48 extends completely around the rectangular array of side walls 42. Therefore, the groove 48 has a rectangular configuration as viewed in a plane extending perpendicular to a central axis 52 of the housing 12 and the push button 14. Of course, the groove 48 could have a configuration other than the illustrated rectangular configuration. For example, the groove 48 could have a circular or triangular configuration.

The groove 48 has a uniform cross sectional configuration (FIG. 2) throughout its extent. The groove 48 has linear flat bottom surfaces 54 which are disposed in a rectangular array and face outward toward and are parallel to the flat inner side surface areas 36 on the housing side walls 34. The depth of the groove 48 is constant throughout the extent of the groove. Therefore, the flat bottom surfaces 54 of the groove 48 are spaced the same distance from the inner side surface areas 36 of the housing side walls 34.

In addition to the flat bottom surfaces 54, the groove 48 has flat lower side surfaces 58 which are disposed in a rectangular array and extend parallel to flat upper side surfaces 60 of the groove. The flat lower and upper side surfaces 58 and 60 extend perpendicular to the flat bottom surfaces 54 of the groove 48 and perpendicular to the inner side surface areas 36 on the side walls 34 of the housing 12. The distance between the lower and upper side surfaces 58 and 60 of the groove 48 is uniform throughout the extent of the groove.

The flat bottom, lower and upper side surfaces 54, 58 and 60 of the groove 48 cooperate to form four linear sections of the groove. The four linear sections of the groove 48 are disposed in a rectangular array and extend around the base 40 of the push button 14. Each of the linear sections of the groove 48 has a longitudinal central axis which extends parallel to the inner side surface area 36 on one of the side walls 34 of the housing 12.

The longitudinal central axes of the linear sections of the groove 48 are disposed in a plane which extends perpendicular to the central axis 52 of the switch assembly 10. The longitudinal central axes of each of the linear sections of the groove 48 is spaced the same distance from one of the bottom surfaces 54 of the groove 48. In addition, each of the central axes of the linear sections of the groove 48 is spaced the same distance from the inner side surface area 36 of one of the side walls 34 of the housing 12.

The side walls 42 of the base 40 of the push button 14 are formed with a pair of retainer sections 64 and 66 which extend outwardly from opposite sides of the base 40 of the push button 14. The retainer sections 64 and 66 engage rectangular openings 68 and 70 formed in an end cap 72. The retainer sections 64 and 66 cooperate with the openings 68 and 70 to fixedly interconnect the base 40 and end cap 72 of the push button 14.

The end cap 72 is formed as one piece of molded translucent polymeric material. The end cap 72 has a rectangular array of side walls 76. The side walls 76 cooperate to form a rectangular space 78 into which the upper portion (as viewed in FIG. 2) of the base 40 of the push button 12 extends.

The side walls 76 of the end cap 72 have outer side surfaces 82 which extend parallel to the inner side surface area 36 on the side wall 34 of the housing 12. The outer side surfaces 82 of the end cap 72 are uniformly spaced from the inner side surface areas 36 on the side walls 34 of the housing 12 at the joint 30. The end cap 72 has a flat upper side wall 86 which is formed as one piece with the side walls 76 and extends perpendicular to the central axis 52 of the switch assembly 10 and to the inner side surface area 36 on the side wall 34 of the housing 12.

The electrical switches 16 (FIG. 2) are disposed in a lower end portion of the housing 12. The switches 16 are actuated by the linkage 18 which is connected with the push button 14. Thus, when the push button 14 is depressed from the extended position shown in FIG. 2 to a retracted position in which the push button is telescoped further into the housing 12, the linkage 18 actuates the electrical switches 16 to change an electrical circuit in which the conductors 20 are connected.

Seal

The improved seal 28 (FIG. 3) is not lubricated by silicone grease or other lubricant. The seal 28 has a generally rectangular configuration and is disposed in the rectangular groove 48 (FIG. 2) in the base 40 of the push button 14. The seal 28 is integrally molded as one piece of a suitable polymeric material. Of course, if the push button 14 and housing 12 had configurations different than the illustrated rectangular configuration, the seal 28 would have a corresponding configuration.

In one specific embodiment of the invention, the seal 28 was molded as a single piece of "Teflon" (trademark). Of course, other suitable polymeric materials could be used if desired. The polymeric material of the seal 28 has a low sliding friction with the smooth inner side surface areas 36 on the side wall 34 of the housing 12. Therefore, silicone grease does not have to be used in association with the seal 28.

The seal 28 (FIG. 3) has four linear sections 92 which are interconnected in a rectangular array. Each of the linear sections 92 of the seal 28 is disposed in one of the linear sections of the rectangular groove 48 (FIG. 2) in the push button 14. Two of the linear sections 92 are provided with notches 94 (FIGS. 3 and 4) to clear projections from the side walls 42 of the base 40 of the push button 14.

Figure 4:
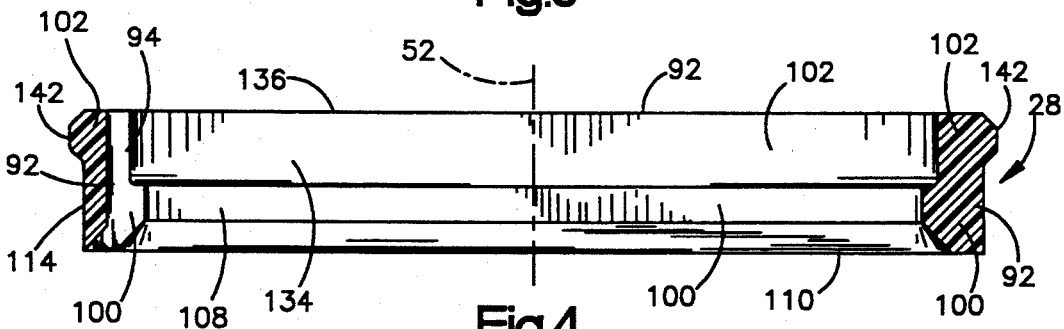
FIG. 4 is a sectional view, taken generally along the line 4—4 of FIG. 3, further illustrating the construction of the seal.

The linear sections 92 of the seal 28 have the same length (FIG. 3). In addition, the linear sections 92 of the seal 28 have the same height (FIG. 4) as measured along the central axis 52 of the switch assembly 10. In one specific embodiment of the seal 28, the linear sections 92 (FIG. 3) had a length of approximately 0.6 inches and a height (FIG. 4) of approximately 0.1 inches. It should be understood that the foregoing specific dimensions for the seal 28 have been set forth herein for purposes of clarity of description and not for purposes of limitation of the invention. It is contemplated that the seal 28 could be formed with many different dimensions and/or many different configurations.

Each of the linear sections 92 of the seal 28 includes a base section 100 (FIG. 5) and an arm section 102 which is integrally molded as one piece with the base section 100. The arm section 102 extends upward (as viewed in FIGS. 2 and 5) from the base section 100. The arm section 102 is connected with the base section 100 in a cantilevered relationship. The cantilevered relationship of the arm section 102 to the base section 100 allows the arm section to be resiliently deflected relative to the base section 100. Thus, the arm section 102 can be resiliently deflected inward (toward the left as viewed in FIG. 5) or outward (toward the right as viewed in FIG. 5).

The base section 100 (FIG. 5) includes a flat linear inner side surface 108. The linear side surface 108 abuttingly engages a flat linear bottom surface 54 of one of the linear sections of the groove 48 (FIG. 2).

The flat linear inner side surfaces 108 on the linear sections 92 of the seal 28 are disposed in a rectangular array. When the seal 28 is in the unstressed condition of FIG. 5, the rectangular array of inner side surfaces 108 is of a size which is slightly smaller than the size of the rectangular array of flat bottom surfaces 54 (FIG. 2) of the groove 48. Therefore, the base sections 100 of the seal 28 are resiliently stretched when the seal 28 is snapped into place in the groove 48 (FIG. 2) in the base 40 of the push button 14. This results in the flat inner side surfaces 108 (FIG. 5) on the base section 100 of each of the linear sections 92 of the seal 28 being pressed firmly against a flat bottom surface 54 of the groove 48. The flat inner side surfaces 108 on the base sections 100 of the seal 28 extend parallel to the longitudinal central axis 52 (FIG. 2) of the switch assembly 10 and to the inner side surface areas 36 on the side walls 34 of the housing 12.

The base section 100 (FIG. 5) has a flat inner end surface 110 which extends perpendicular to the flat inner side surface 108. During movement of the push button 14 upward (as viewed in FIG. 2) from the retracted position toward the extended position, the flat inner end surface 110 (FIG. 5) on the seal 28 abuttingly engages the flat lower side surface 58 (FIG. 2) of the groove 48. During movement of the push button in a downward direction (as viewed in FIG. 2) from the extended position toward the retracted position, the flat inner end surface 110 on the base 100 of the seal 28 moves away from and is spaced a slight distance from the flat lower side surface 58 of the groove 48.

The linear base section 100 of each linear segment 92 of the seal 28 has a flat linear outer side surface 114. The outer side surface 114 extends parallel to the inner side surface 108 and perpendicular to the inner end surface 110 (FIG. 5) on the base section 100. The flat outer side surface 114 on the base section 100 is spaced from and extends parallel to the flat smooth inner side surface areas 36 on the side walls 34 of the housing 12 (FIG. 2).

The outer side surface 114 on the base section 100 of the seal 28 faces toward and remains in a spaced apart parallel relationship with the inner side surface area 36 on the adjacent side wall 34 of the housing 12 during movement of the push button 14 between the extended and retracted positions. The distance between the inner side surface 108 and the outer side surface 114 on the base section 100 (FIG. 5) of the seal 28 is approximately the same as the depth of the groove 48 in the base section 40 of the push button 14.

The base section 100 (FIG. 5) of the linear section 92 of the seal 28 has a flat outer end surface 118. The outer end surface 118 extends parallel to the inner end surface 110 and perpendicular to the inner side surface 108 and outer side surface 114 of the base section 100. The arm section 102 extends upward (as viewed in FIG. 5) from the outer end surface 108 of the base section 100.

The arm section 102 is disposed in a cantilevered relationship with the base section 100. Thus, the arm section 102 has a fixed end portion 122 (FIG. 5) which connects the cantilevered arm section 102 with the base section 100. In addition, the arm section 102 has a free end portion 124. The free end portion 124 is connected with the fixed end portion 122 of the arm section 102 by an intermediate portion 126 of the arm section.

The free end portion 124 of the arm section 102 engages the smooth inner side surface area 36 on the side wall 34 of the housing 12 (FIG. 2). However, the intermediate portion 126 and fixed end portion 122 of the arm section 102 remain spaced apart from the inner side surface area 36 of the side wall 34 of the housing 12 during movement of the push button 14 between the extended and retracted positions. The intermediate portion 126 and fixed end portion 122 of the arm section 102 remain spaced apart from the bottom surface 54 of the groove 48 and the push button 14 during movement of the push button between the extended and retracted positions.

The fixed end portion 122 (FIG. 5) and intermediate portion 126 of the cantilevered arm section 102 have a flat outer side surface 132 which is formed as a continuation of the flat outer side surface 114 of the base section 100. The flat outer side surface 132 of the arm section 102 extends parallel to the longitudinal central axis 52 (FIG. 2) of the switch assembly 10 and to the inner side surface area 36 on the adjacent side wall 34 of the housing 12. During movement of the push button 42 between the extended and retracted positions, the outer side surface 132 on the arm section 102 is spaced from the inner side surface area 36 on the adjacent side wall 34 of the housing 12.

In addition, the arm section 102 (FIG. 5) has a flat inner side surface 134 which extends upward and perpendicular to the outer end surface 118 of the base section 100. The flat inner side surface 134 of the arm section 102 extends from the fixed end portion 122 along the intermediate portion 126 and along the free end portion 24 of the arm section 102 to a flat outer end surface 136 of the arm section 102. The flat inner side surface 134 extends parallel to the flat outer side surface 132. During movement of the push button 14 (FIG. 2) between the extended and retracted positions, the inner side surface 134 (FIG. 5) on the arm section 102 is spaced from the bottom surface 54 (FIG. 2) of the groove 48.

Figure 5:
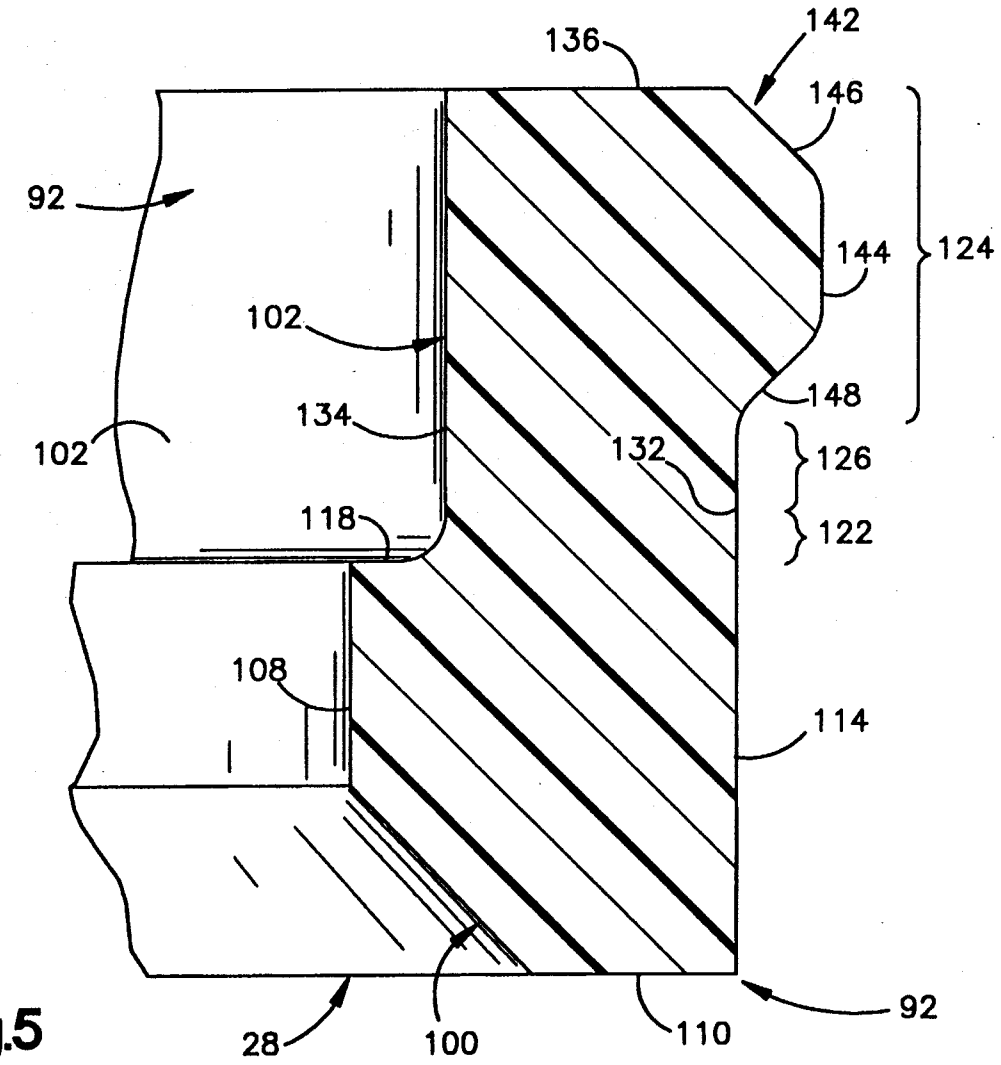
FIG. 5 is an enlarged fragmentary sectional view illustrating a portion of the seal of FIGS. 3 and 4 in an unstressed condition.

The flat outer end surface 136 of the arm section 102 extends parallel to the inner end surface 110 of the base section 100 (FIG. 5). During movement of the push button 14 from the extended position toward the retracted position, the outer end surface 136 on the arm section 102 engages the upper side surface 60 (FIG. 2) of the groove 48 to retain the seal 28 in the groove. During movement of the push button 14 from the retracted position toward the extended position, the outer end surface 136 of the arm section 102 is slightly spaced from the upper side surface 60 of the groove 48, as shown in FIG. 2.

The free end portion 124 (FIG. 5) of the cantilevered arm section 102 includes a nose portion 142 which engages the inner side surface area 36 on a side wall 34 of the housing 12 (FIG. 2). The nose portion 142 of the arm section 102 (FIG. 5) projects from the flat outer side surface 132 in a direction away from the flat inner side surface 134. The nose portion 124 has a flat central surface 144 which extends parallel to the inner side surface 134 of the arm section 102 and parallel to the outer side surface 114 of the base section 100. When the seal 28 is in an unstressed condition, as shown in FIG. 5, the central surface 144 of the nose portion 142 is disposed in flat abutting engagement with the inner side surface area 36 of the side wall 34 of the housing 12.

In addition, the nose portion 142 includes an outer side surface 146 which slopes away from the central surface 144 of the nose portion 142 toward the outer end surface 136 of the arm section 102. Similarly, an inner side surface 148 slopes inwardly toward the outer side surface 132 of the intermediate portion 126 of the arm section 102. The outer side surface 146 and the inner side surface 148 are both skewed at an angle of approximately 45° to the central surface 144 of the nose portion 142. Small arcuate chamfers interconnect the outer side surface 146 and the inner side surface 148 with the central surface 144 of the nose portion 142. It should be understood that the outer side surface 146 and the inner side surface 148 could be skewed at a different angle relative to the central surface 144 of the nose portion 142 if desired.

Operation

When the push button 14 (FIG. 2) is depressed against the influence of the biasing spring 33 by manual pressure against the end cap 72, the push button moves downward (as viewed in FIG. 2) from the extended position shown in FIG. 2 toward the retracted position. As the push button 14 moves downward into the housing 12, the linkage 18 actuates the electrical switches 16. Actuation of the electrical switches 16 changes the condition of an electrical circuit with which the switches are connected.

Figure 6:
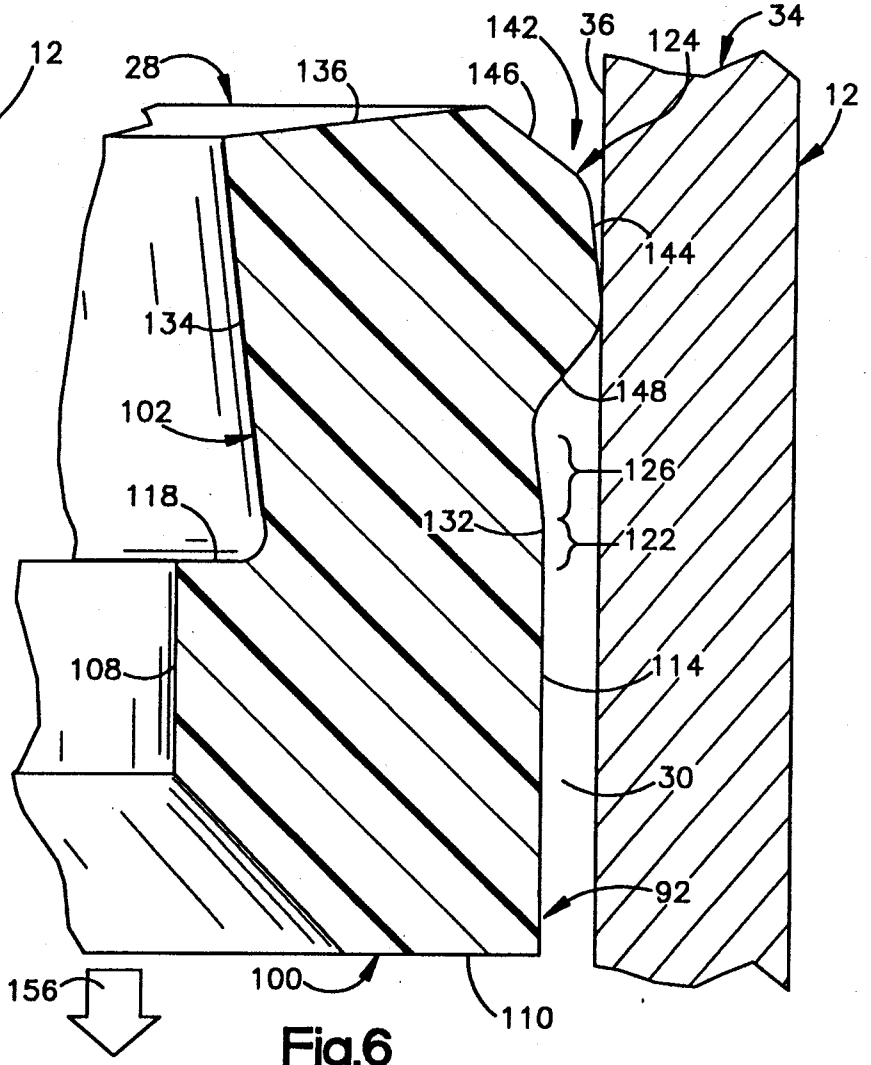
FIG. 6 is a schematicized sectional view illustrating the manner in which the seal is resiliently deflected in tension during movement of the push button from an extended position toward a retracted position.

As the push button 14 moves from the extended position of FIG. 2 toward the retracted position, in the manner indicated by the arrow 156 in FIG. 6, the free end portion 124 on the arm section 102 of the seal 28 slides along the inner side surface area 36 of the side wall 34 of the housing. As this occurs, friction forces between the free end portion 124 of the arm section 102 and the inner side surface area 36 of the side wall 34 resiliently deflect the arm section in tension in an axial direction opposite to the arrow 156. Simultaneously therewith, the arm section 102 of the seal is deflected away from the side wall 34 of the housing 12 and the joint 30 to the orientation illustrated schematically in FIG. 6. However, the arm section 102 is not deflected so far inward as to engage the bottom surface 54 of the groove 48 in the push button 14.

When the arm section 102 of the seal is in the orientation illustrated in FIG. 6, the free end portion 124 of the arm section has substantially line contact with the inner side surface 36 of the side wall 34 of the housing. The line contact between the free end portion 124 of the arm section 102 and the inner side surface area of the side wall 34 occurs at the lower (as viewed in FIG. 6) edge of the flat surface 144 on the nose portion 142 of the arm section. This line contact results in the seal 28 providing relatively little resistance to the downward (as viewed in FIG. 6) movement of the push button 14 (FIG. 2). The polymeric material of the seal 28 provides relatively little frictional resistance to movement of the seal 28 along the inner side surface of the side wall 34 even though there is no silicone grease or other lubricant provided in the joint 30 in association with the seal.

When the push button 14 has been moved to its retracted position, the linkage 18 has actuated the switches 16 and the push button 14 is released. Upon releasing of the push button 14, the spring 33 applies force against the base 40 of the push button and moves the push button upward (as viewed in FIG. 2) toward the extended position.

Upon initiation of movement of the push button 14 from the retracted position back toward the extended position, the seal 28 is in the orientation shown in FIG. 6 relative to the side wall 34 of the housing 12. As soon as upward (as viewed in FIG. 6) movement of the push button 14 begins, the central surface 144 on the nose portion 142 of the arm section 102 moves into flat abutting engagement with the inner side surface 36 of the side wall 34. As this occurs, the seal 28 returns to the unstressed condition of FIG. 5.

As the initial upward movement of the seal 28 and the push button 14 continues, friction forces applied against the central surface 144 of the seal 28 by the inner side surface 36 of the side wall 34 load the seal 28 in compression. The friction forces cause the arm section 102 to pivot toward the joint 30 and side wall 34 to the orientation shown in FIG. 7. As this occurs, the seal 28 is compressed and material in the nose portion 142 of the seal is pressed against the inner side surface 36 of the side wall 34.

If the retracted push button 14 is quickly released, the force of the spring 33 on the push button tends to cause the push button to rapidly accelerate and overtravel or move past the desired extended position. However, the seal 28 cooperates with the housing 12 to provide a relatively large resistance to movement of the push button 14 toward the extended position. The resistance provided by the seal 28 dampens the acceleration of the push button 14 so that it moves to the extended position in a controlled manner and does not overtravel the extended position and pop-out of the housing 12.

Figure 7:
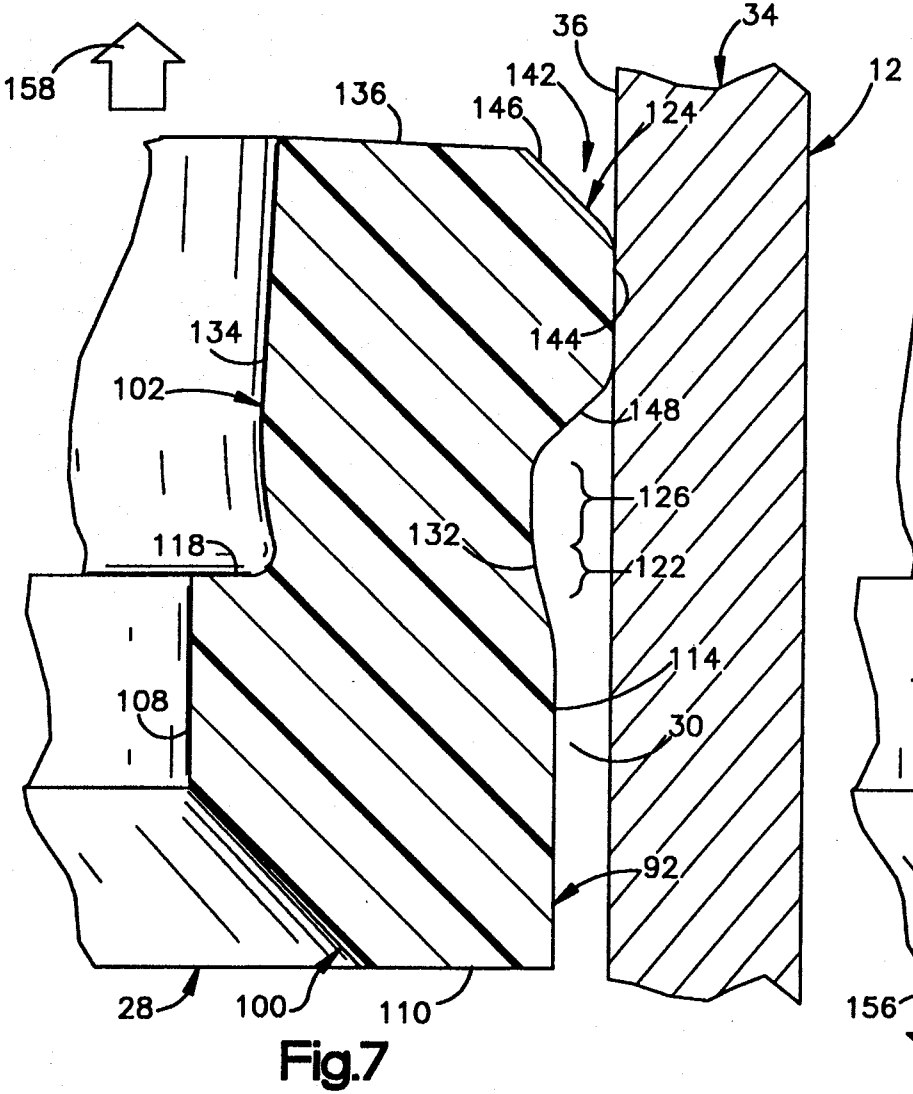
FIG. 7 is a schematicized sectional view, generally similar to FIG. 6, illustrating the manner in which the seal is resiliently deflected in compression during movement of the push button from the retracted position toward the extended position.

As the push button 14 moves toward the extended position, the seal 28 moves upward, in the manner indicated by the arrow 158 in FIG. 7. As the seal 28 moves upward, the nose portion 142 on the free end portion 124 of the arm section 102 slides along the inner side surface area 36 of the side wall 34. As this occurs, friction forces between the free end portion 124 of the arm section 102 and the inner side surface 36 of the side wall 34 resiliently deflect the arm section 102 in compression in an axial direction opposite to the arrow 158 in FIG. 7. Simultaneously therewith, the arm section 102 of the seal is resiliently deflected outward toward the side wall 34 of the housing 12 and the joint 30. As this occurs, the material of the nose portion 142 of the arm section 102 is wedged or forced into the joint 30. Wedging the material of the nose portion 142 of the arm section 102 into the joint 30 jams the material of the seal 28 against the side wall 34 of the housing 12 to provide a relatively large resistance to upward movement of the push button 14.

This relatively large resistance to upward movement of the push button 14 results in the push button moving upward to the extended position in a controlled manner which prevents overtravel of the push button past the extended position and pop-out of the push button from the housing 12. As the push button 14 moves upward to the extended position, substantially the entire flat surface 144 on the nose portion 142 of the arm section 102 is in engagement with and is being pressed against the inner side surface area 36 of the side wall 34.

Summary

In view of the foregoing description, it is apparent that the switch assembly 10 includes a push button 14 which is movable relative to a housing 12 between an extended position and a retracted position to actuate electrical switches 16 in the switch assembly. A seal 28 is provided to seal a joint 30 between the push button 14 and the housing 12. The seal 28 does not require silicone grease.

The improved seal 28 provides relatively small resistance to movement of the push button 14 from the extended position to the retracted position. However, the seal 28 provides a relatively large resistance to movement of the push button 14 from the retracted position to the extended position. By providing a relatively large resistance to movement of the push button 14 from the retracted position to the extended position, the seal 28 prevents overtravel of the push button past the extended position.

The improved seal 28 has a base section 100 which is connected with the push button 14. A cantilevered arm section 102 extends from the base section 100 and has a free end portion 124 which engages a side wall 34 of the housing 12. The free end portion 124 of the arm section 102 transmits force between the arm section and the housing 12. This force resiliently tensions the arm section 102 and deflects the arm section away from the joint 30 between the push button 14 and the housing 12 during movement of the push button from the extended position toward the retracted position (FIG. 6). The arm section 102 is resiliently compressed and deflected toward the joint 30 between the push button and the housing 12 during movement of the push button 14 from the retracted position back toward the extended position (FIG. 7).

Having described the invention, the following is claimed:

1. A switch assembly comprising a housing, a push button movable relative to said housing between an extended position and a retracted position, said push button being movable from the extended position to the retracted position under the influence of manual force applied against said push button, biasing means in said switch assembly for urging said push button toward the extended position, and seal means for sealing a joint between said push button and said housing, said seal means including means for providing a first resistance to movement of said push button from the extended position to the retracted position and for providing a second resistance larger than said first resistance to movement of said push button from the retracted position to the extended position under the influence of said biasing means to prevent movement of said push button past the extended position under the influence of force transmitted to said push button from said biasing means.

2. A switch assembly as set forth in claim 1 wherein said means for providing a first resistance to movement of said push button from the extended position to the retracted position and for providing a second resistance to movement of said push button from the retracted position to the extended position includes a nose portion of said seal means, said nose portion being deflected away from the joint between said push button and said housing by forces applied against said nose portion by a surface on said housing during movement of said push button toward the retracted position and being deflected toward the joint between said push button and said housing by forces applied against said nose portion by the surface on said housing during movement of said push button toward the extended position.

3. A switch assembly as set forth in claim 1 wherein said seal means includes a base section which is connected with said push button and a cantilevered arm section which is integrally formed as one-piece with said base section and has a first end portion which is connected with said base section and a free end portion, said arm section extending from said base section to said free end portion in the direction of movement of said push button from the retracted position to the extended position, said free end portion of said arm section having surface means which engages said housing and transmits force between said housing and said arm section to deflect said arm section away from said housing during movement of said push button from the extended position to the retracted position and which transmits force between said housing and said arm section to deflect said arm section toward said housing during movement of said push button from the retracted position to the extended position.

4. A switch assembly as set forth in claim 3 wherein an intermediate portion of said arm section is disposed between said first end portion and said free end portion of said arm section, said intermediate portion of said arm section being maintained in a spaced apart relationship with said push button and with said housing during movement of said push button between the extended and retracted positions.

5. A switch assembly as set forth in claim 4 wherein said base section extends around said push button and resiliently grips said push button, said base section being spaced from said housing during movement of said push button between the extended and retracted positions.

6. A switch assembly as set forth in claim 1 wherein said seal means includes a base section which is connected with said push button and a cantilevered arm section having a first end portion connected with said base section and free end portion, said arm section being resiliently deflected in tension under the influence of force transmitted between said free end portion of said arm section and said housing during movement of said push button from the extended position to the retracted position, said arm section being resiliently deflected in compression under the influence of force transmitted between said free end portion of said arm section and said housing during movement of said push button from the retracted position to the extended position.

7. A switch assembly as set forth in claim 6 wherein said push button has a rectangular cross sectional configuration in a plane extending perpendicular to a path of movement of said push button between the extended and retracted positions, said push button having surface means for defining a groove which extends around said push button about a central axis which is parallel to the path of movement of said push button between the extended and retracted positions, said base section and said arm section of said seal means having linear segments which are disposed in said groove in said push button.

8. A switch assembly as set forth in claim 1 further including a plurality of electrical switches disposed in said housing and linkage means connected with said push button for actuating said electrical switches upon movement of said push button between the extended and retracted positions.

9. A switch assembly as set forth in claim 1 wherein said seal means includes a base section which is connected with said push button, an arm section which is integrally formed as one piece with said base section and has a first end portion which is connected with said base section and a free end portion, said arm section extending from said base section to said free end portion in the direction of movement of said push button from the retracted position to the extended position, said free end portion of said arm section having surface means for camming said free end portion of said arm section away from said housing and sliding freely along said housing during movement of said push button from the extended position to the retracted position, said surface means on said free end portion of said arm section being effective to wedge said free end portion of said arm section into the joint between said push button and said housing during movement of said push button from the retracted position to the extended position.

10. A switch assembly comprising a housing having a rectangular array of side walls, each of said side walls having a flat side surface area which faces inward toward a central portion of said rectangular array of side walls, electrical switch means disposed within said housing for changing an electrical circuit upon actuation of said electrical switch means, a push button having a rectangular array of side surfaces which are at least partially disposed within said rectangular array of side walls, said push button being movable relative to said housing in a direction toward said electrical switch means from an extended position to a retracted position and being movable relative to said housing in a direction away from said electrical switch means from the retracted position to the extended position, said push button including a groove which extends around said push button and has a rectangular array of linear sections which open outward of the rectangular array toward said flat side surface areas on said side walls, each of said linear sections of said groove having a bottom surface which faces toward one of said flat surface areas on said side walls, means for actuating said electrical switch means upon movement of said push button between the extended and retracted positions, and a one-piece seal disposed in said groove in said push button, said seal having a plurality of linear sections each of which is disposed in one of said linear sections of said groove in said push button, each of said linear sections of said seal including a base section which engages the bottom surface of one of said linear sections of said groove and is spaced from said side walls of said housing, an arm section which is integrally formed as one-piece with said base section and has a first end portion which is connected with said base section and a free end portion, said arm section extending from said base section to said free end portion of said arm section in the direction of movement of said push button from the retracted position to the extended position, said free end portion of said arm section having a surface which engages a flat side surface area on one of said side walls during movement of said push button between the extended and retracted positions.

11. A switch assembly as set forth in claim 10 wherein said free end portion of said arm section of each of said linear sections of said seal has a first orientation relative to said push button and the flat side surface area on one of said side walls which is engaged by said free end portion of said arm section during movement of said push button toward the retracted position, said free end portion of said arm section of said push button having a second orientation relative to said push button and the flat side surface area on the one of said side walls which is engaged by said free end portion of said arm section during movement of said push button toward the extended position, said free end portion of said arm section providing a greater resistance to movement of said push button relative to said housing when said free end portion of said arm section is in the second orientation than when the free end portion of said arm section is in the first orientation.

12. A switch assembly as set forth in claim 11 wherein said free end portion of said arm section of each of said linear sections of said seal includes a first flat surface area, a second flat surface area which is skewed at an acute angle to said first flat surface area and slopes away from said first flat surface area in the direction of movement of said push button from the extended position toward the retracted position, and a third flat surface area which is skewed at an acute angle to said first flat surface area and slopes away from said first flat surface area in the direction of movement of said push button from the retracted position toward the extended position.

13. A switch assembly as set forth in claim 10 wherein said arm section of each of said linear sections of said seal has an intermediate section which extends between said first end portion of said arm section and said free end portion of said arm section, said intermediate section of said arm section being spaced from said side walls of said housing and from said push button during movement of said push button between the extended and retracted positions.

14. A switch assembly as set forth in claim 13 wherein said base section of each of said linear sections of said seal is spaced from said side walls of said housing during movement of said push button between the extended and retracted positions.

15. A switch assembly as set forth in claim 10 wherein each of said linear sections of said groove has a parallel side surface, said free end portion of said arm section of each of said linear sections of said seal being disposed in engagement with one of said side surfaces of each of said linear sections of said groove during at least a portion of the movement of said push button from the extended position to the retracted position, said free end portion of said arm section of each of said linear sections of said seal being spaced from said one of said side surfaces of each of said linear sections of said groove during at least a portion of the movement of said push button from the retracted position to the extended position.

16. A switch assembly as set forth in claim 15 wherein said base section of each of said linear sections of said seal is spaced from said side walls of said housing and spaced from a second one of said side surfaces of-each of said linear sections of said groove during at least a portion of the movement of said push button from the extended position to the retracted position, said base section of each of said linear sections of said seal being disposed in engagement with said second one of said side surfaces of each of said linear sections of said groove during at least a portion of the movement of said push button from the retracted position the extended position.

17. A switch assembly as set forth in claim 10 wherein said arm section of each of said linear sections of said seal is resiliently deflected in tension under the influence of force applied against the free end portion of said arm section by a flat side surface area on one of said side walls during movement of said push button from the extended position to the retracted position, said arm section of each of said linear sections of said seal being resiliently deflected in compression under the influence of force applied against the free end portion of said arm section by a flat side surface area on one of said side walls during movement of said push button from the retracted position to the extended position.

* * * * *